US005477508A

United States Patent [19]

Will

[11] Patent Number: 5,477,508

[45] Date of Patent: Dec. 19, 1995

[54] CONTROL OF DIGITAL WATCH USING MENU AND THUMBWHEEL

[76] Inventor: Craig A. Will, 2110 Paul Edwin Ter. #101, Falls Church, Va. 22043

[21] Appl. No.: 251,207

[22] Filed: May 31, 1994

[51] Int. Cl.[6] ..... G04C 17/00

[52] U.S. Cl. ..... 368/189; 368/281; 368/69

[58] Field of Search ..... 368/280–282, 368/69–70, 185–190

[56] References Cited

U.S. PATENT DOCUMENTS

| | | | |
|---|---|---|---|
| 3,541,541 | 11/1970 | Engelbart | 340/324 |
| 3,835,464 | 9/1974 | Rider | 340/324 A |
| 4,115,993 | 9/1978 | Moriya | 368/72 |
| 4,257,115 | 3/1981 | Hatuse | 368/69 |
| 4,354,260 | 10/1982 | Planzo | 368/10 |
| 4,358,837 | 11/1982 | Yamazaki et al. | 368/69 |
| 4,395,134 | 7/1983 | Luce | 368/3 |
| 4,881,179 | 11/1989 | Vincent | 368/41 |
| 4,905,213 | 2/1990 | Masse et al. | 368/10 |
| 4,982,388 | 1/1991 | Erard | 368/223 |
| 5,088,070 | 2/1992 | Shiff | 368/10 |
| 5,208,736 | 5/1993 | Crooks et al. | 361/393 |
| 5,257,244 | 10/1993 | Thinesen | 368/41 |

OTHER PUBLICATIONS

Sedgwick, "The Complexity Problem", *Atlantic Monthly*, vol. 271, No. 3, pp. 96–104 (Mar., 1993).

Mills, Joshua "Among Desktop Users, Support Grows for the Trackball", New York Times, Jan. 9, 1994, p. 12.

Lampson, B. W. "Personal Distributed Computing: The Alto and Ethernet Software", from Goldberg, Adele, *A History of Personal Workstations* ACM Press, New York, 1988.

*Primary Examiner*—Bernard Roskoski

[57] ABSTRACT

A method and apparatus for control of a digital watch and associated functions, based on a user interface with a menu and thumbwheel. The watch consists of an internal clock, microprocessor, display, rotating cylinder (thumbwheel) operated by the thumb or finger, and a button. The display consists of a matrix of pixels and can display menus or other information with small characters and time and date information in a larger size. Rotating the cylinder results in changing the designated item in a menu, which is typically indicated in reverse video, and pressing the button results in the designated item being selected. In cases where a parameter is modified and the values of the parameter are well known and have a natural order (such as minutes) only the present value of the parameter is displayed, and movement of the thumbwheel causes the displayed value to be incremented or decremented, as appropriate. Pressing the selector button causes the actual value of the parameter to be replaced by the displayed value. The use of a hierarchical set of menus and a thumbwheel allows control of a watch with only a single button and avoids excessive dependence on multiple buttons the function of which is context-dependent and difficult to learn and to remember.

12 Claims, 9 Drawing Sheets

FRONT VIEW

CONTROL OF DIGITAL WATCH USING MENU AND THUMBWHEEL

FIELD OF THE INVENTION

The invention disclosed here relates to devices for measuring time in the form of watches that use electronic circuitry and manually actuated electro-optical displays. The invention relates particularly to methods for the control by a human of such devices, particularly displays using liquid crystals and that include microprocessors, and devices that control the display of time and date information, the setting of the current time and date, provide a display in plural time zones, and have functions that provide for alarms, the measurement of time intervals, numerical calculations, and data storage and retrieval.

More specifically, the invention relates to a method and apparatus for the control of a digital watch by displaying a menu of choices, with a rotating cylinder (or "thumbwheel") and a selector button used to designate and select the desired choice.

BACKGROUND OF THE INVENTION

A significant problem in using today's digital watches is their complexity. A recent article in *The Atlantic Monthly* ("The Complexity Problem", March, 1993, p. 96) reported that a line of advanced digital watches produced by a manufacturer "was being returned as defective by the thousands, even though the watches actually worked perfectly well." The returns were made either soon after purchase or "thereafter in two large batches—in the spring and the fall, when the time changed", with the primary problem the difficulty of user's being able to reset such a complex watch.

The essential problem with control of a digital watch is that there is little space available for buttons and keys, and designers have found it necessary to device procedures in which a small number of keys are pressed into service to perform increasingly complex functions. Typically, this is done by using one or more buttons that, when pressed, moves the watch sequentially through a set of modes. Thus, for example, the watch may begin in a normal time display mode and then, after a single press of the mode button, change to "alarm" mode, which displays and allows resetting of the time and dates for an alarm. A second press of the mode button might display the time in multiple time zones, a third make available a "Countdown alarm", and a fourth provides a stopwatch, with the fifth press returning the watch to its normal time display mode.

Similarly, the pressing of a different mode button might place the watch into a special mode for setting the time. The pressing of the first button might then shift the watch into a sequence of specific modes for setting the watch, with each mode allowing the setting of seconds, hours, minutes, month, date, and year, with successive presses.

Within each mode other buttons are used for particular functions. For example, in the timesetting function a particular button might, when pressed, advance the "minutes" parameter from "45" to "46". However, typically, there is not button allowing a decrementing of the value, and users are often frustrated by having to cycle through all of the values from 46 to 59, then 0, and again to 45, for example. While most watches now have a function in which holding down the button for a period of time causes repetitive advancing, without the user having to continually repeat the step of pressing the button, people often miss stopping at the correct time and must cycle through again. In general, the "mode" orientation of the user interface of conventional digital watches and the tendency to force many functions into a small number of buttons results in the function of most buttons being highly context dependent, with no obvious metaphor or model for the user to follow to remember a button's function in a particular context.

Given that watches today are so accurate that setting is done very infrequently (for many users only twice a year when changing from standard to daylight time and back again), users typically retain little skill in the task and frequently misplace their instruction manuals some time after purchase of the watch, and often find such manuals very difficult to understand. The net result of this is a high degree of frustration and an inability to correctly use the watch for many users.

As digital watches become more complex they are becoming increasingly difficult to use, and it is probably fair to say that the primary obstacle to the further development of value and functionality in a digital watch may soon be, if it is not already, the limits posed by the cognitive complexity of the watch, rather than the ability to economically and compactly manufacture additional computing and display functions.

Another limitation on the inclusion of additional functions into watches is the unwieldy number of keys that are required for use of these functions. Such functions as calculators and data storage and retrieval systems (used, for example, for names and telephone numbers) typically require not only control functions but a relatively large set of input values (e.g., the digits 0–9 and operators in the case of a calculator, the digits 0–9 and letters A–Z for data retrieval systems). Conventional watches that contain these functions are typically provided with a substantial number of keys to allow their operation. For example, the Casio World Time Databank Calculator has 16 keys and 4 buttons. Of the 16 keys, 13 have 3 functions—a given press can mean one of two different letters or a digit, depending upon the context. The size of such keys is generally so small that users typically make large numbers of errors in pressing the keys. Another recently introduced watch of considerable utility results from combining a watch with a miniature remote control for televisions and videocassette recorders. However, the number and size of the keys required to be added to the watch to allow this function is a major disadvantage.

In some watches a display with a "menu" of functions that can be selected is provided, including the DBX-100 Databank Watch manufactured by Casio Computer Corp. and and the Windsurfer watch manufactured by Citizen Watch Company. In both cases, a menu of potential selections is displayed, with the selected option indicated. Repeated pressing of a button results in changing the selection. The Moriya invention (U.S. Pat. No. 4,115,993) describes a digital alarm watch in which manual switches select one of a set of channels of alarm times, with the particular channel selected displayed, and with manual switches capable of resetting the alarm time. The Planzo invention (U.S. Pat. No. 4,354,260) describes a personal data storage and retrieval system that is part of a digital watch. Digits and letters are entered by the user by initiating an action in which a set of digits or letters are displayed sequentially, one by one, with the user pressing a button to enter the letter that was most recently presented. The Hatuse, et al invention (U.S. Pat. No. 4,257,115) is a watch with a touch sensitive area surrounding each number on the display of an analog clock face. Pressing the area around the numerals 1–9 enters the corresponding digit, while pressing "10" enters the digit 0, and pressing "11" and "12" enters control functions.

In addition, the Sheff invention (U.S. Pat. No. 5,088,070) describes a menu-based interface in which choices are made from a matrix of rows and columns on a display. The basic input device is a set of four buttons arranged like the points of a compass, with each button, if pressed, resulting in movement up, left, down, or right of a designation that marks a choice, such as turning on a marker near a menu choice. A fifth button, in the center of the other four, actually chooses the selection when pressed. A variation provides a hemisphere such that pressing down the hemisphere in one of the four directions can result in closing a switch that has the same effect as if one of the four buttons was pressed, and pressing the sphere directly downward has the stone effect as pressing the central button.

The above approaches typically require multiple presses of buttons or similar actions, and typically either are so small that they are difficult to operate or are too large to fit easily in the usual watch configuration (which is generally flat). What is needed is an approach in which a small number of input devices is used, with some property of the device (such as amount, direction, and speed of movement) capability of encoding much more information than is the on-off switches used in the above inventions, and in which the device has a shape and motion that is compatible with the physical requirements of the typical watch.

SUMMARY OF THE INVENTION

The goal of the invention disclosed here is to provide a method and apparatus for the control of a digital watch that is particularly easy to use and to learn, and for which the user is likely to retain the skill of using even after long periods of not using particular functions. The invention also makes it possible to include complex functions in a watch, such as a calculator, without the necessity of providing additional keys.

The system makes use of menu displays and a rotating cylinder, or "thumbwheel", operated by the thumb or finger of the user. The watch typically makes use of a display that is higher density than those used in conventional watches, with characters displayed as patterns of pixels, either dots or squares, rather than 7- or 9-segment groupings. This allows the display of relatively large characters for time and date information presented in a basic time display, and use of the same part of the display for information in smaller characters for menus containing choices, other time and date information, and the display of text liar providing help to the user. The basic time display could also be analog, with simulated clock hands and numerals.

The apparatus for control of the watch consists of a microprocessor, memory, display, thumbwheel, encoder, and selector button. (A separate button and lamp can also be included to provide light in the dark, if desired.)

In operation, the watch displays the current time and date according to a standard format in large characters. When the user presses the selector button, a menu of choices is displayed, such as "Time zone" (display time in other time zones), "Alarm" (show or set alarm), "Stopwatch", "Calculator" (use calculator function), and "Set time" (set time or date).

A menu typically lists such choices displayed as horizontal lines, with one such line designated as special by some means, such as displaying the text in reverse video (in which normally black characters on a white background are displayed as white characters on a black background). Movement of the thumbwheel up or down results in corresponding movement of the designated item in the menu. The user then presses a selector button to complete the choice. Frequently, more choices are contained in the menu than can be displayed. When this occurs, only part of the menu is displayed, with additional choices presented by scrolling past the top or bottom choice, as appropriate.

Choosing one item from the first menu presented typically results in presentation of a screen for that function, which usually includes a label indicating the screen, status information, and a menu for the user to choose frown. In some cases (such as, for example, the "set minutes" screen) a screen will not contain a menu but will present a single parameter, indicated by displaying it in reverse video, like that of a menu item. This is done in situations where the number of choices is large but where the set and order of items is relatively obvious. Thus, the "set minutes" screen displays the current value of the "minutes" parameter, which is known to have a potential value from 00 to 59. In this case movement of the thumbwheel will result in display of the parameter with an increased or decreased value depending upon the direction of movement of the thumbwheel. Again, the user presses the selector button to complete the choice.

The menu and thumbwheel interface also allows control of and input to complex functions that are often combined in a watch but that require many additional keys in conventional watches. This includes calculators and data retrieval systems that, for example, store names and telephone numbers, and miniaturized television and video cassette recorder remote controls. In such cases the menus often display multiple menu items on a single line (such as, for example, the digits 0–9), and the designation in reverse video is done only for selection of the item rather than the entire line. In this case, movement of the thumbwheel in a downward direction results in movement of the designation to the fight until the rightmost item is designated, after which the designation moves to the leftmost item on the line below.

The system uses a hierarchical menu organization and a very simple design with a small number of relatively context-free rules. A single press of the selector button has only two meanings: (1) to display the basic menu, should the watch be in its normal display mode: and (2) to select an option from a menu, should a menu be displayed.

A double press of the button (in quick succession) will cause the watch to return to its normal display mode. Each menu typically has a set of options followed by two specific choices at the end of the menu. (1) "Return"; and (2) "Help". "Return" results in the display of the menu previously displayed, while taking no action. "Help" results in display of text to explain the operation of the particular function or screen.

DESCRIPTION OF THE PREFERRED EMBODIMENTS

Figure 1:
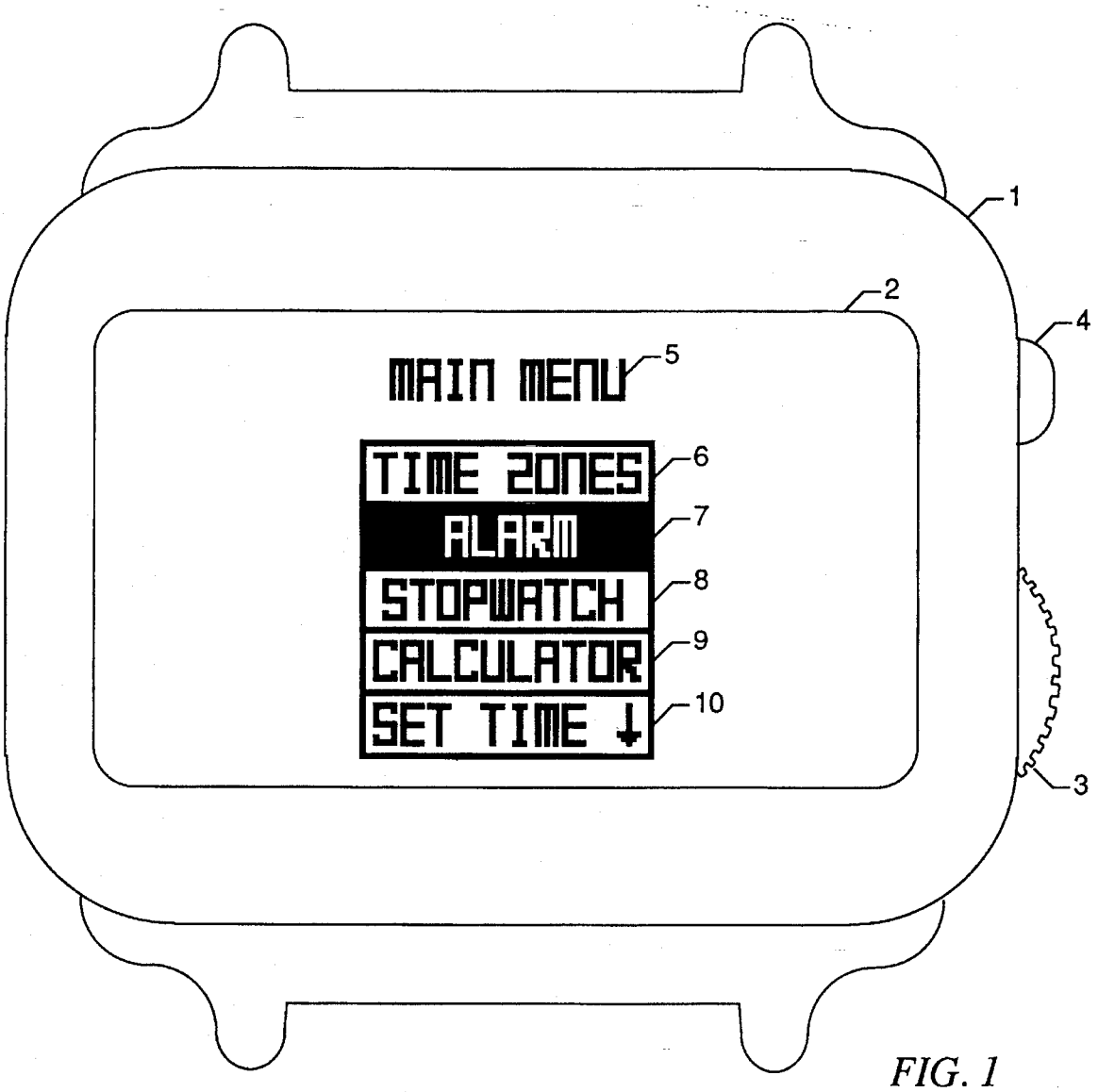
FIG. 1 shows the display, controls, and packaging of the digital watch in the configuration with a thumbwheel and selector button both mounted on the same side of the case, and an example of a display in the control mode.

FIG. 1 shows the display, controls, and packaging of the digital watch in the configuration with a thumbwheel and selector button both mounted on the same side of the case, and an example of a display in the control mode. The watch case 1 contains a display 2, a rotating cylinder or thumbwheel 3 and a selector button 4. The display 2 shows a display of the "Main menu", the primary screen for control of the watch. At the top is a label for the screen 5, while the lines 6, 7, 8, 9, and 10 are items in a menu. At any given time one item is designated by some special mode of display, such as reverse video, as shown for the "Alarm" item 7. (Alternative ways of indicating such a designation include (1) displaying a symbol, such as an arrow, adjacent to the item; (2) blinking the item: and (3) drawing a dashed line around the item.) Rotating the thumbwheel 3 up or down results in the designation of an item being moved up or down, respectively. In addition, in the case of some menus, those items displayed are only part of the complete menu, with that displayed a window into the complete menu. In those cases moving the designated item to the bottom 10, for example, will result in a scrolling action that moves the window and displays additional menu items (and erases others). Note the downward arrow symbol 10 that indicates that there are additional items in the menu below the bottom line. If there were additional items above the top item 6, that item would have an upward arrow.

Figure 2:
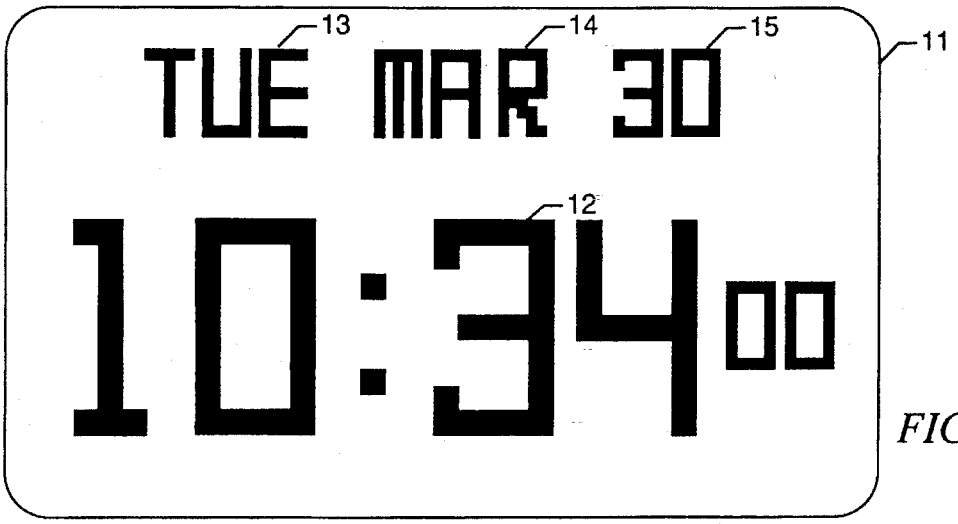
FIG. 2 shows a display in the time display mode of the digital watch.

FIG. 2 shows a display in the time display mode of the digital watch. The display 11 shows the time 12 in hours, minutes, and seconds in large digits (smaller for seconds), as well as day of the week 13, month 14, and date 15. The watch is normally in this mode; pressing the selector button will cause the watch to go to the "Main menu" mode shown in FIG. 1. At any time during control of the watch a double pressing of the selector button will terminate control mode and cause the watch to go back into time display mode. Display of the characters is shown in FIGS. 1 and 2 in the form of 5×9 pixels that each consist of squares that are turned on or off. The horizontal and vertical lines in FIG. 1 are each one pixel in width, and the menu items in FIG. 1 are shown as 5×9 matrices of pixels. The day, month, and date shown in FIG. 2 are double size (10×18 matrices), and the time (hours and minutes) is shown at five times that of the menu items, or 25×45 matrices of pixels, but with each character still displayed as 5×9 squares, with each square in this case having 4 or 25 pixels, respectively. A pixel representation is necessary, since the 7- or 9-segment codes normally used to display characters with liquid crystal display technology do not lend themselves to the use of the same physical area for displaying characters in more than one font size. The technique shown for control of the watch using menu and thumbwheel could be used with LCD segment codes if the time display was made smaller and occupied a dedicated part of the display, although that approach would result in considerably less flexibility in screen design than would a pixel representation. The entire area used for display in the pixel representation here is approximately a 90×165 matrix, or a total of 14,850 bits, with exact dimensions dependent on spacing. Pixels are displayed in binary; that is, they are either on or off.

Figure 3A:
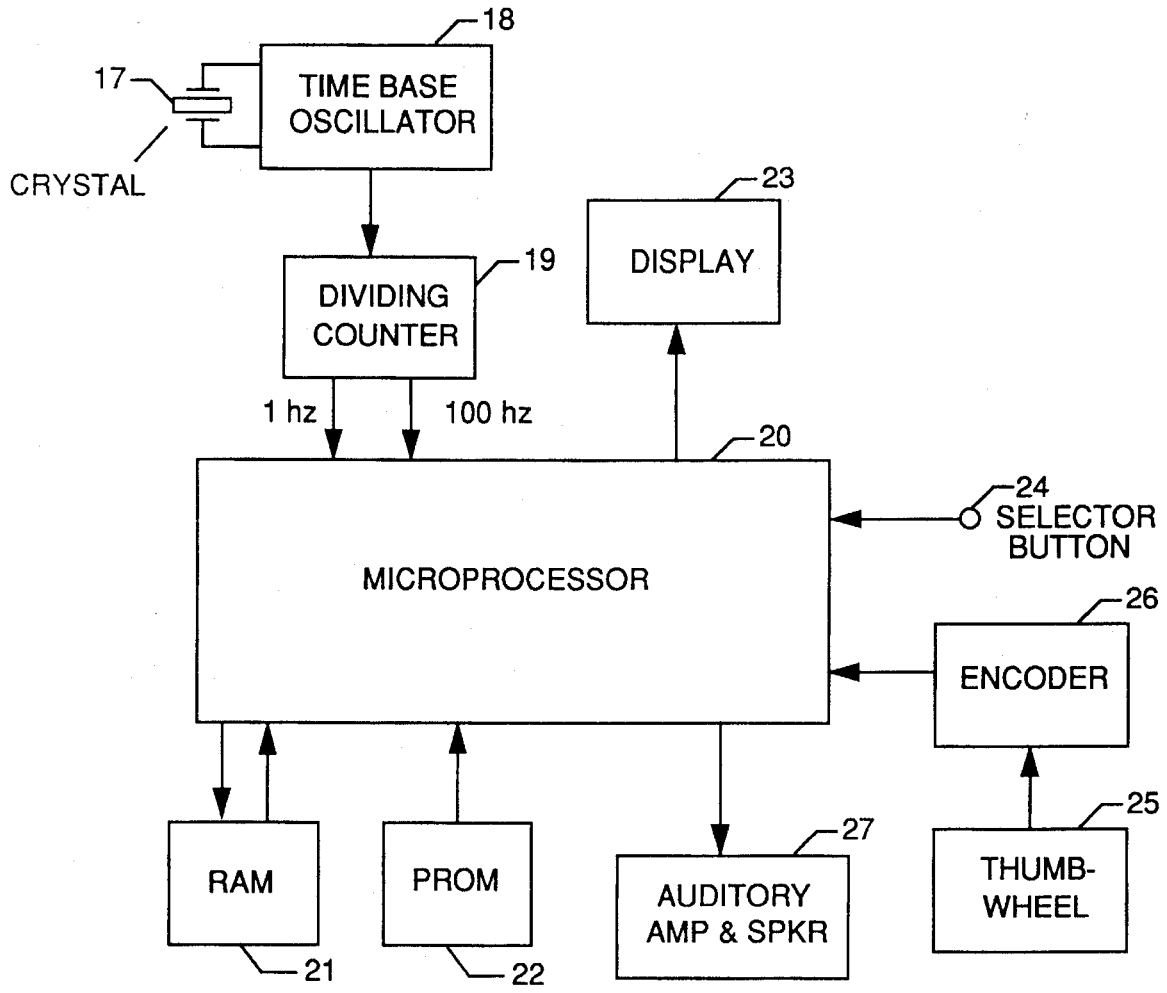
FIGS. 3*a* and 3*b* show the hardware architecture for the digital watch.
Figure 3B:
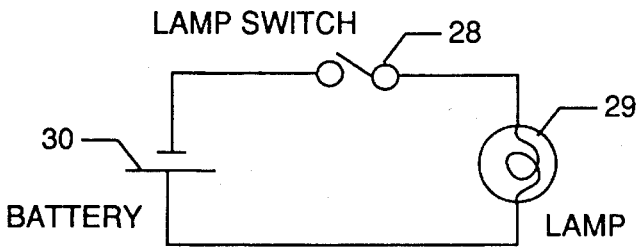

FIGS. 3*a* and 3*b* show the hardware architecture for the digital watch. In FIG. 3*a*, a crystal 17 and associated time base oscillator 18 produces a sequence of pulses driving a frequency dividing counter 19 with two output frequencies, 100 hz and 1 hz. Both bit streams are read into the microprocessor 20, which uses this information to update software counters kept in random access memory 21 (RAM) that control all timing functions. The software program controlling the microprocessor 20 is contained in a programmable read only memory 22 (PROM). A display 23 contains a memory, address logic, display drivers, and optoelectronics for display of the characters and other symbols, in the form of binary pixels. A thumbwheel 25 or rotating cylinder operated by the user's thumb or finger is moved by the user when desired, and as it is moved an encoder 26 generates pulses that are transmitted to the microprocessor 20. The encoder coverts rotation of the thumbwheel, which is connected to a shaft, to pulses that encode angular movement. The shaft might, for example, be connected to a disk with holes arranged in a circle, spaced at equal intervals. A light source, such as a light emitting diode, is positioned at a fixed point on one side of the disk while a light sensor, such as a photosensitive diode, is positioned at the other side of the disk. Interruptions of the light as it is passed or blocked by the holes in or solid parts of the disk result in the pulses. A pair of photosensitive diodes spaced appropriately allows both the detection of movement and its direction (by determining which pulse is first). A selector button 24, when pressed by the user, transmits a signal to the microprocessor. The watch also contains an auditory amplifier and speaker 27 and appropriate control logic for alarms and beeps. In FIG. 3*b*, a lamp button 28, independent of the microprocessor and associated electronics, turns on a lamp 29 to illuminate the display (when in the dark) by completing a circuit with battery 30.

Figure 4:
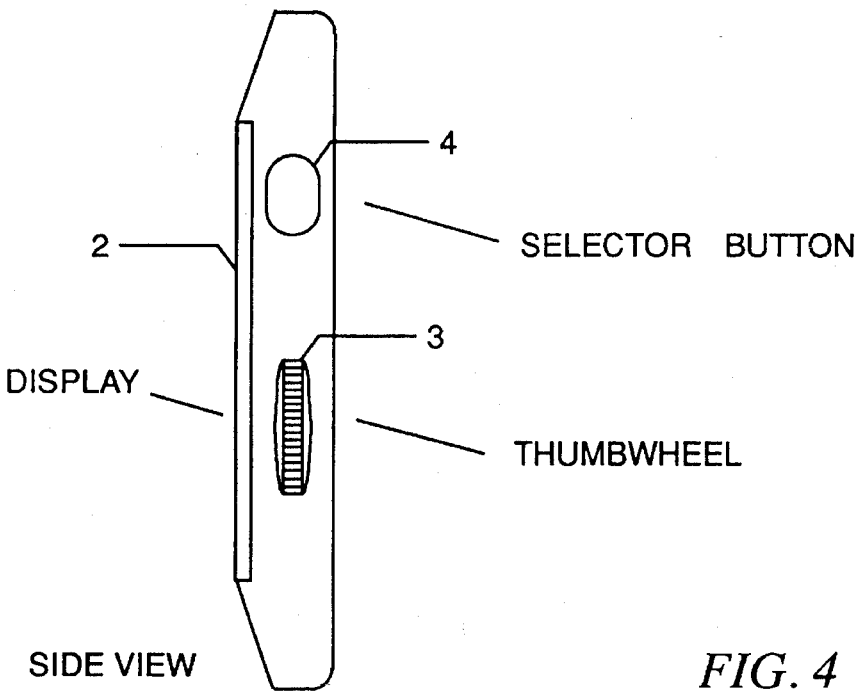
FIG. 4 shows an additional (side) view of the watch configuration with the thumbwheel and selector button on the stone side of the case.

FIG. 4 shows an additional (side) view of the watch configuration with the thumbwheel and selector button on the same side of the case. This is the same configuration as shown in FIG. 1, and shows display 2, thumbwheel 3, and selector button 4. This configuration shows the thumbwheel mounted with its axis of rotation perpendicular to the plane of the display, which allows the thumbwheel itself to be relatively large and thus easily manipulated, while allowing the watch case to be relatively flat. Note that the term "thumbwheel" is used here for convenience and because of historical usage of the variation "thumbwheel switch", which has long been known. However, the thumbwheel can be operated either by the thumb, index finger, or, conceivably, another finger. Whether the device is operated by a user's thumb or index linger can depend on many factors, including the physical arrangement of the thumbwheel and associated selector button, the size of these devices, whether the user is right- or left-handed, and the preferences of particular users. The view in FIG. 4 shows both the thumbwheel and selector button on the right-hand side of the watch (right-hand as seen from a user viewing the display). A right-handed user would be likely to use an index finger for both thumbwheel and selector button with this arrangement.

Figure 5:
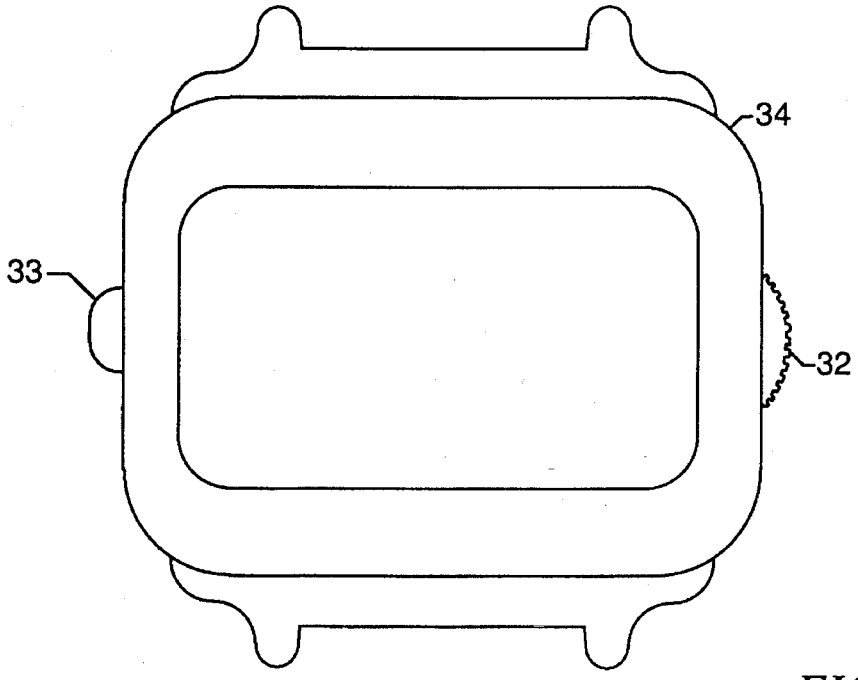
FIG. 5 shows an alternative arrangement in which the thumbwheel is on one side of the watch and the selector button is on the other.

FIG. 5 shows an alternative arrangement in which the thumbwheel is on one side of the watch and the selector button is on the other. Here the thumbwheel 32 is on the right-hand side of the watch and the selector button 33 (operated simultaneously by the thumb in a squeezing motion) on the left-hand side of the watch case 34. This allows (in a right-handed user) the use of an index finger, which is smaller and generally has finer movement control, for the thumbwheel, and the use of the thumb on the selector button, which requires less fine movement control. This configuration also allows a variation on movement and selection, in which the movement of the thumbwheel does not have any effect unless the button is also simultaneously pressed, and letting up the button, or letting it up and pressing it down a second time, results in a selection.

Figure 6A:
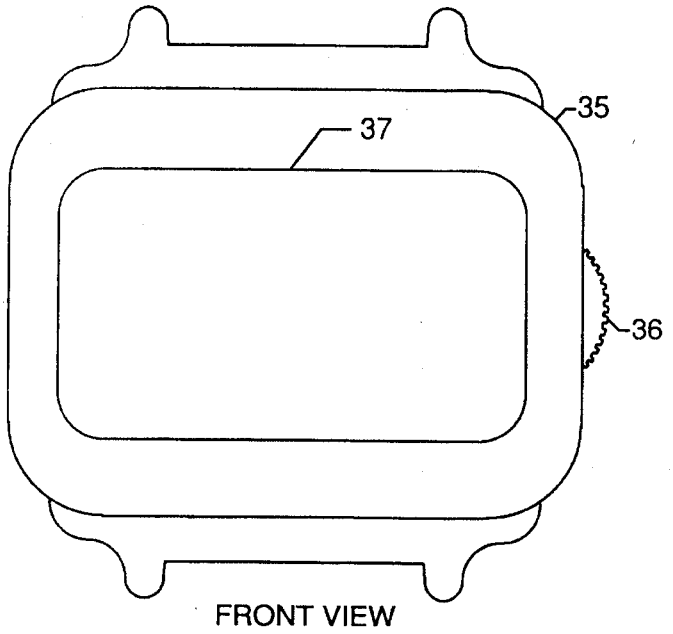
FIGS. 6*a* and 6*b* show front and side views of the watch case with a thumbwheel that simultaneously serves as a a selector button.
Figure 6B:
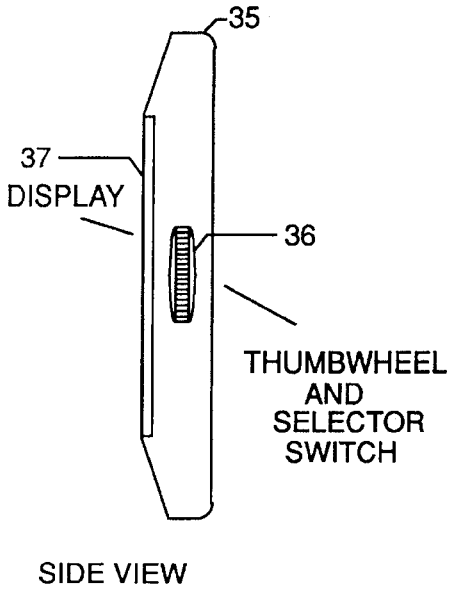

FIGS. 6*a* and 6*b* show front and side views of the watch case with a thumbwheel that simultaneously serves as a a selector button. The watch case 35 contains only one control device, the thumbwheel 36. (A button may also be added to control a lamp for illuminating the display 37 in the dark). This is convenient for the user because the user can move the thumbwheel and select the result in a single motion, and is also potentially more accurate than using a separate button that requires the user to take his or her finger off of the thumbwheel (and risk disturbing its position) or potentially disturb the position of the thumbwheel by movement of the thumb to press a button elsewhere on the watch.

Figure 7A:
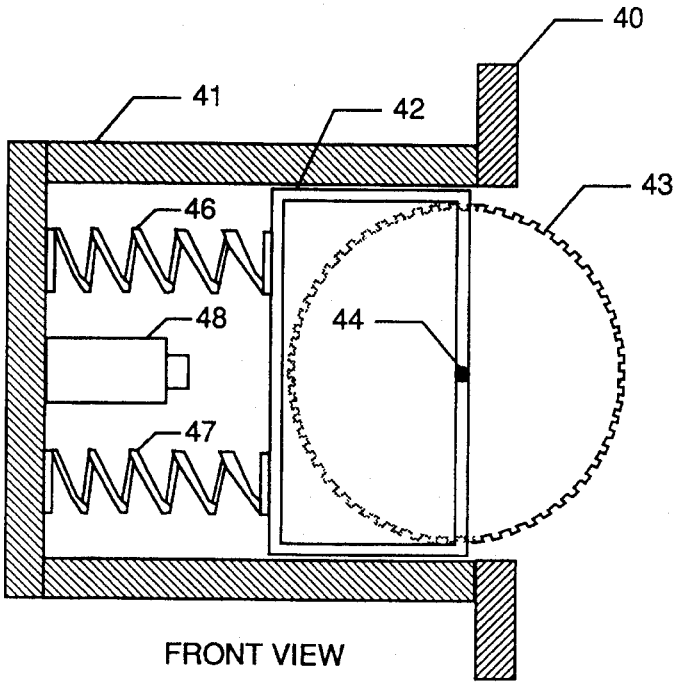
FIGS. 7*a* and 7*b* show details of the thumbwheel that also serves as a selector button.
Figure 7B:
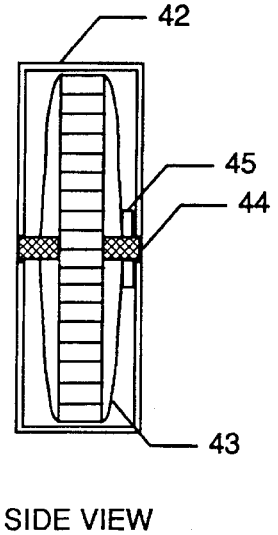

FIGS. 7*a* and 7*b* show details of the thumbwheel that also serves as a selector button. At the left in FIG. 7*a* is a front view of the watch case, showing a blowup beneath the outer packaging and the display in the area near the thumbwheel. The right side of the watch case 40 contains a fixed frame 41. Within this frame a second movable frame 42, or box, is constructed that contains the thumbwheel 43, with a shaft 44 connecting the thumbwheel to the frame, but sufficiently loosely that the thumbwheel can rotate. The movable frame 42 is also shown in a side view in FIG. 7*b* (from the right side of the watch case) showing the thumbwheel 43, shaft 44, and encoder 45. The encoder is in two pieces, a piece attached to the shaft that rotates with the thumbwheel, and a second nonrotating piece that receives and processes the pulses. The rotating piece, for example, can be a disk with holes in it, and the nonrotating piece (attached to the movable frame) a light source and photosensitive diode and associated logic, with the second piece attached by flexible wires (not shown) to the watch case and microprocessor. As is seen in the front view, when the user has completed rotating the thumbwheel 43 and presses it toward the left (perpendicular to the watch case), the movable frame moves toward the fixed frame 41. The movement is resisted by springs 46 and 47, but, with sufficient force, the frame will move so as to press the switch 48 and complete the selection.

Figure 8:
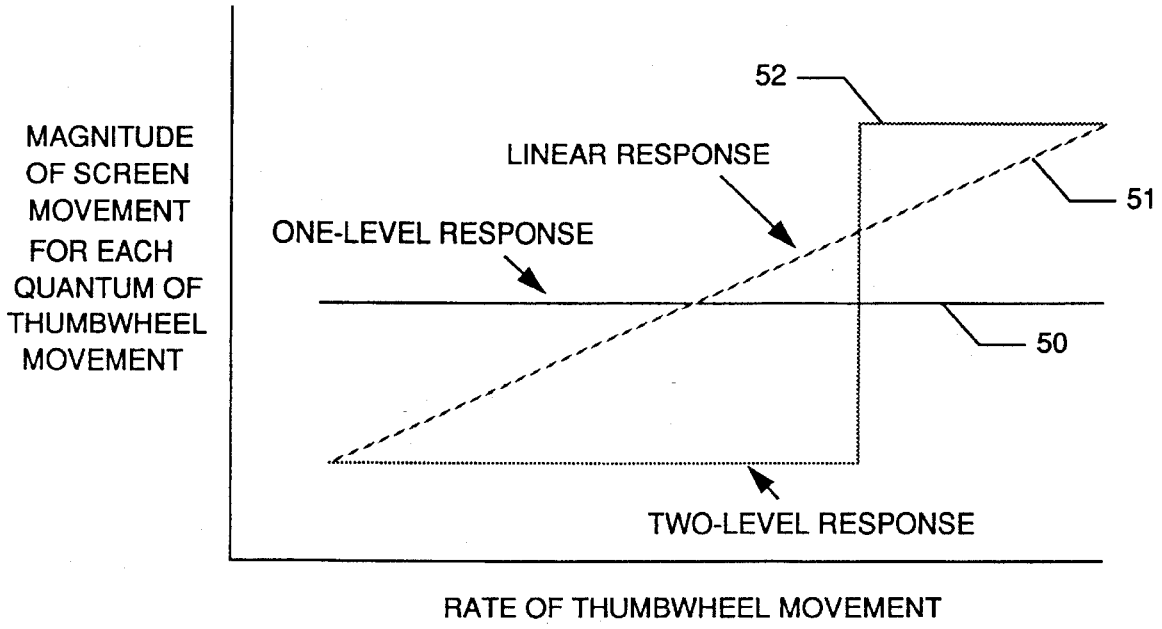
FIG. 8 shows a graph describing the amount of movement of the designation of a menu item on the display screen resulting frown physical movement of the thumbwheel at different rates.

FIG. 8 shows a graph describing the amount of movement of the designation of a menu item on the display screen resulting from physical movement of the thumbwheel at different rates. The graph shows the amount of physical movement on the screen resulting from movement of the thumbwheel sufficient to produce a single pulse from the encoder. Three curves are shown. The curve 50 shows a one-level (flat) response characteristic, in which the same amount of display movement results regardless of the rate of thumbwheel movement. The curve 51, in contrast, is used to improve the accuracy of short movements while allowing long movements to be made with greater speed, and has movement on the screen proportional to the rate of thumbwheel movement. The curve 52 has a purpose similar to that of 51, but works in one of two modes, either a "slow, precise" mode or a "rapid, coarse" mode, with the magnitude of screen movement for a given thumbwheel movement constant, depending upon the mode. The ratio between the rapid and slow rates is about 4:1. The two latter curves 51 and 52 are valuable when the thumbwheel is used to select from long sequences of choices, such as digits and operators that are used in a calculator, digits used in entering a telephone number, or letters and digits and control commands used in applications such as telephone and address directories. The two-level (or multiple-level) response is the preferred mechanism because it provides both the slow and precise versus rapid and coarse modes while, within the range of each mode, providing a response in which the distance moved on the screen is proportional to the distance moved by the thumbwheel. This is the more natural response and is likely to be the easiest to learn.

FIGS. 9*a* through 9*d* show screens illustrating the user interface for the main menu and the multiple time zones function.

Figure 9A:
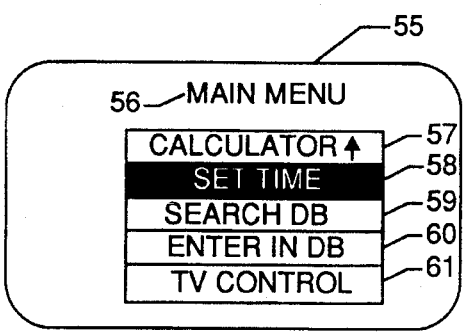
FIGS. 9*a* through 9*d* show screens illustrating the user interface for the main menu and the multiple time zones function.

Note that the primary screen ("Main menu") has already been shown as FIG. 2. Screen 55 in FIG. 9*a* shows a main menu after a user has moved the thumbwheel to scroll down the menu, showing the screen label 56 and the menu items 57, 58, 59, 60, and 61. Note that the top item has an uparrow indicating that additional undisplayed items exist at the beginning of the menu.

Depending upon the design of the thumbwheel and selector buttons, there may be a problem with accidental pressing of the selector, which could result in the watch accidentally going into main menu mode from time display mode and then, with a second accidental press, into another mode. This can be avoided, if it is a problem, by providing a clock function such that the watch will not remain in main menu function more than a set amount of time, such as 60 or 120 seconds, returning to the time display mode after that period of time has elapsed. In addition, for the main menu screen and for other critical screens (such as the time setting verification screen), the watch can be set to ignore any selections that are the default selections—that is, the item designated when the menu was first displayed—unless the user moves the thumbwheel to another menu item and then back. This would prevent a second accidental press from moving the watch past the main menu.

Figure 9B:
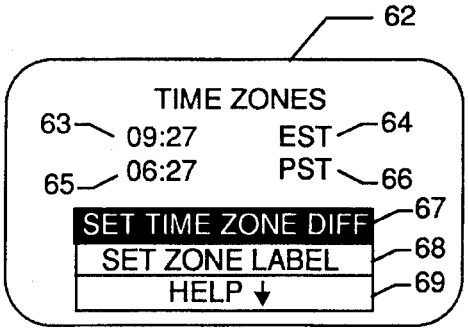

Screen 62 in FIG. 9*b* shows the primary screen for the multiple time zones function, including the screen label 62, the primary time 63 and optional time zone label 64, secondary (zone 2) time 65 and optional time zone label 66. Also shown are menu choices, to set the difference 67 in hours between the primary and secondary time zones, a choice to set the time zone label for the primary time, and a "help" choice 69 to request information.

Figure 9C:
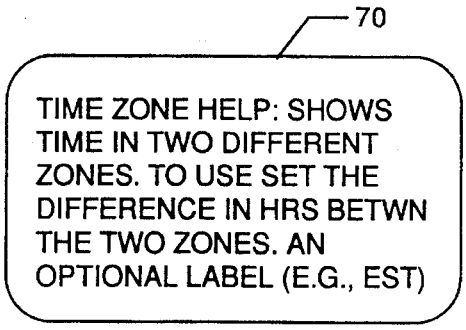
Figure 9D:
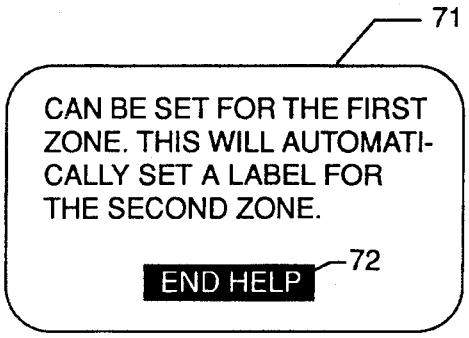

Screen 70 in FIG. 9*c* shows the first part of the "help information". If the user moves the thumbwheel down to scroll through the information (assuming it extends beyond a single screen), additional information will appear, as shown in screen 71, in FIG. 9*d* followed by a single menu choice 72 to end the help display and return the user to the previous menu 62.

FIGS. 10*a* through 10*h* show screens illustrating user interfaces for multiple time zones, stopwatch, and calculator functions of the watch.

Figure 10A:
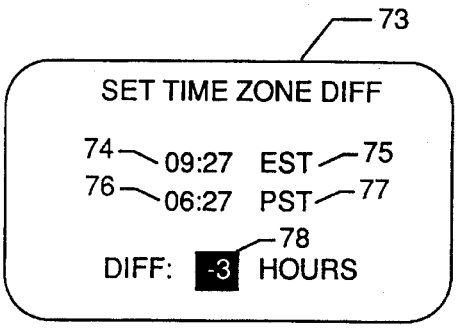
FIGS. 10*a* through 10*h* show screens illustrating user interfaces for multiple time zones, stopwatch, and calculator functions of the watch.

Screen 73 in FIG. 10*a* shows the screen for setting the difference between the primary and secondary time zones. The screen displays the primary time 74 and optional associated time zone label 75, the secondary time 76 and optional associated time zone label 77. Also displayed is the difference in hours 78 (shown as −3), with the modifiable field displayed in reverse video. The time zone difference ranges from −12 to +12 hours, in that order, and moving the thumbwheel will cause the value displayed in the field to be replaced so as to display (in this case) −2, −1, 0, +1, etc. if the thumbwheel is moved down and −4, −5, −6, etc. if the thumbwheel is moved up. If the thumbwheel is moved to the end of the range (−10, −11, −12) additional items, including "Return" and "Help" are displayed, with movement beyond those items resulting in display of the values at the opposite end of the range (+12, +11, +10, etc.). Pressing the selector button will result in the designated value replacing the current value immediately.

Figure 10B:
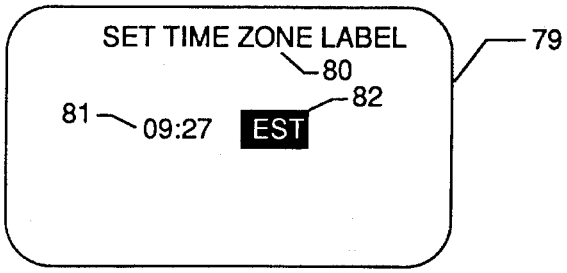

Screen 79 in FIG. 10*b* shows the screen for setting the label for the primary time zone, including the screen label 80, current time 81, and the current value of the time zone label displayed in reverse video 82. Movement of the thumbwheel results in changing the value of the label according to the order that time zone labels naturally occur. Thus, if the current label is "EST", movement of the thumbwheel up results in replacement of the current label with the following in sequence: "CST", "MST", "PST", etc.

Figure 10C:
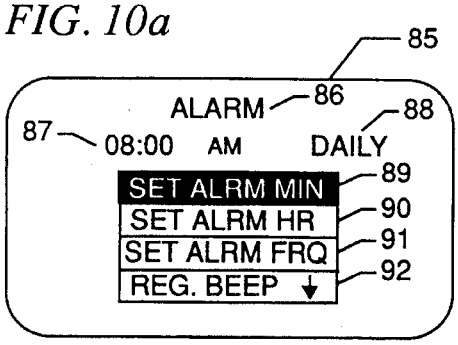

Screen 85 in FIG. 10*c* shows the primary menu for the "Alarm" function, which displays the screen label 86, the time 87 set for the alarm to go off, the frequency 88, shown here as "Daily", and a menu that allows setting of the alarm time (minutes 89, hour 90) and frequency 91. Also included in the menu is an item 92 ("Reg. Beep") to get to a screen 105 that displays and controls a single or double beep at regular intervals.

Figure 10D:
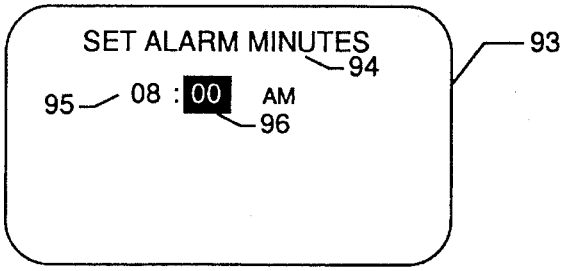

Screen 93 in FIG. 10*d* shows the screen displayed when the "Set alarm minutes" item frown the menu in screen 85 is selected. The screen label 94 is shown, as is the time in hours 95 and the minutes parameter 96. Movement of the thumbwheel up or down results in change of the displayed value (of 96 here) in an appropriate natural direction (01, 02, 03 if the direction is down. 59, 58, 57 if the direction is up). Pressing the selector button will cause the value of the parameter to be changed.

Figure 10E:
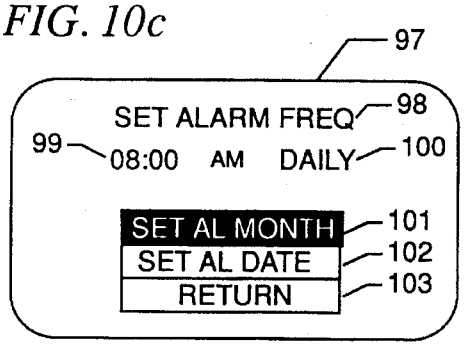

Screen 97 in FIG. 10*e* shows the screen for setting the frequency of the alarm, which displays the screen label 98, current time 99, and alarm frequency 100. The frequency displayed here is "Daily" but could alternately be a specific date (month and day of month). (Although not shown in the screen, the frequency could also be "Weekly", set by indicating a day of the week.) The menu displayed is adaptive and depends upon the values set. The selection of either "Select alarm month" 101 or "Select alarm date" 102 results in presentation of a screen for setting these parameters (not shown); when both of these are set the alarm frequency is set to a particular month and date. In this case the menu shown would have as its first item "Set daily".

Figure 10F:
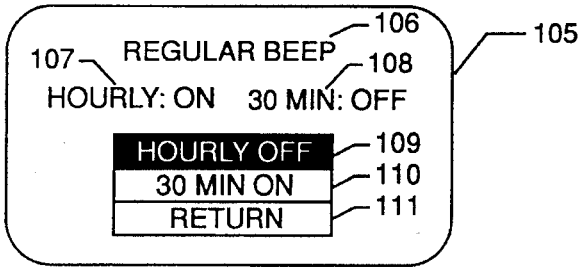

Screen 105 in FIG. 10*f* shows the screen for setting parameters that result in an hourly or half-hourly regular beep, including the screen label 106, the status of the hourly signal 107 (on or off), the status of the 30-minute signal 108 (on or off), and a menu of items 109 and 110 that can be selected to change the above status parameters. Selecting the "Return" choice 111 without selecting either of the above will result in no change of the status parameters.

Figure 10G:
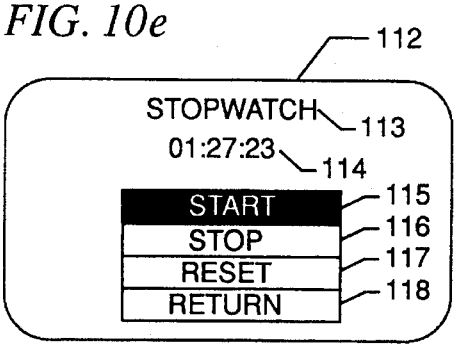

Screen 112 in FIG. 10*g* shows the screen for controlling a stopwatch function, including the screen label 113, stopwatch time indicating time elapsed in minutes, seconds, and hundredths of seconds 114, and a menu of items including "Start" 115, "Stop" 116. "Reset" 117, and "Return" 118 which start the timer, stop it, reset it to 0, and return from the screen, respectively.

Figure 10H:
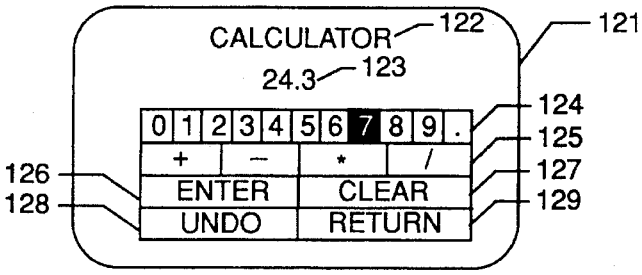

Screen 121 in FIG. 10*h* shows the user interface for the calculator, including screen label 122, calculator accumulator 123, and menu of input items. The menu includes the digits 0–9 and a decimal point 124, operators +, −, *, and / 125, plus the commands "Enter" 126. "Clear" 127, "Undo" 128, and "Return" 129. Movement of the thumbwheel in the "down" or clockwise direction moves the selection of a menu item from left to right within a line, and then to the leftmost item on the line just below. Selection of a number or an operator and number (either followed by "Enter") results in the value of the number, or accumulator, operator, and number expression, being evaluated and placed in the accumulator 123. "Clear" will reset the accumulator to 0. "Undo" will result in the last entry being ignored, with the value displayed in the accumulator field reverting to that displayed previous to the last entry. "Return" will cause the main menu 5 (FIG. 1) to be displayed. Note that the movement on the screen resulting from movement of the thumbwheel is carried out at a different rate if more than one menu item is contained on a horizontal line. See the text associated with FIG. 13.

FIGS. 11*a* through 11*j* show the screens illustrating the user interfaces for the time setting and database search and entry functions and television remote control.

Figure 11A:
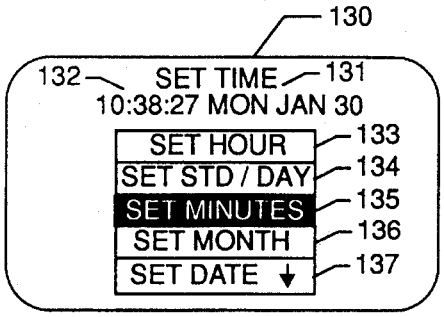
FIGS. 11*a* through 11*j* show the screens illustrating the user interfaces for the time setting and database search and entry functions and television remote control.

Screen 130 in FIG. 11*a* is displayed when the "Set time" selection is made (see FIG. 1), including screen label 131, time and date 132, and menu items 133, 134, 135, 136, and 137. Note that the time and date presented is the tithe tentatively set (but not verified) if it is different from the verified time. Each of these, if selected, presents a screen for setting a particular parameter.

Figure 11B:
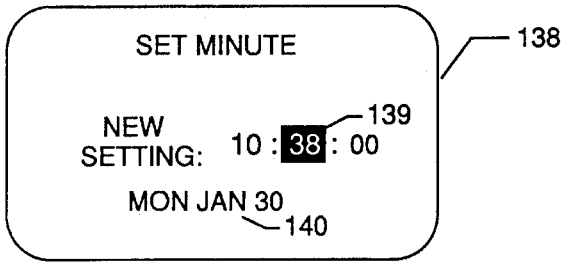

Screen 138 in FIG. 11*b* shows the screen for the "Set minute" selection. This format shows the "New setting" of the time, which is a tentative setting of a new time and month, date, and day-of-the-week 140. The parameter that can be changed 139 is displayed in reverse video, and movement of the thumbwheel up or down results in decreasing or increasing, respectively, the new value of the parameter. Note that this does not yet change the actual value of the time. Similar formats allow modification of the hour, month, date, and day.

Figure 11C:
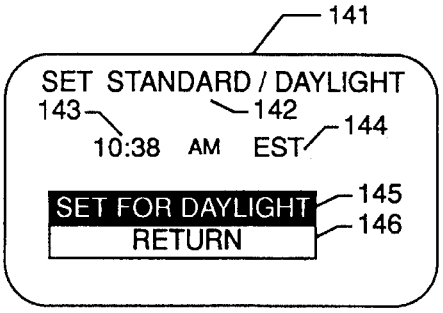

Screen 141 in FIG. 11*c* is a screen specially designed to make it easy to change to daylight savings time and back to standard time. The screen includes screen label 142, current time 143, time zone label for the current time 144, and menu items 145 and 146. The primary menu selection is dependent on the current time zone label: if it is standard time, as shown, the choice is "Set for daylight"; if daylight, the choice is "Set for standard". Making such a choice has two effects: (1) it changes the time zone label, frown EST to EDT in the example shown; and (2) it changes the hour parameter of the time, from 10 to 11 in the example shown.

Figure 11D:
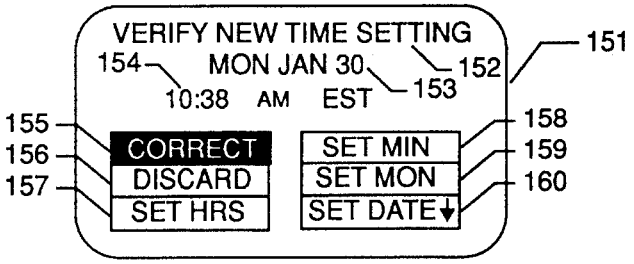

Screen 151 in FIG. 11*d* shows the screen for verifying the new time setting, including the screen label 152, date 153, tentative new time 154, and a menu of items 155, 156, 157, 158, 159, and 160. Note that the menu consists of two columns with significant space between the two to distinguish it from the format in which more than one menu item is on the same line. The rule here is that movement of the thumbwheel down frown item 157 moves the designator to item 158. The same display movement rate is used for this format as in the single-column, one-item-per-line format. "Correct" 155 results in the watch accepting the new time setting and setting the current time to it. "Discard" results in discarding the new setting and returning to the main menu. Other choices cause screens to be presented that allow further modification of time parameters. The modification of any time parameter by selection results in presentation of screen 151. (Alternatively, setting any parameter could return the watch to screen 130, with one of the choices added to the menu of that screen being "Verify new time".)

Figure 11E:
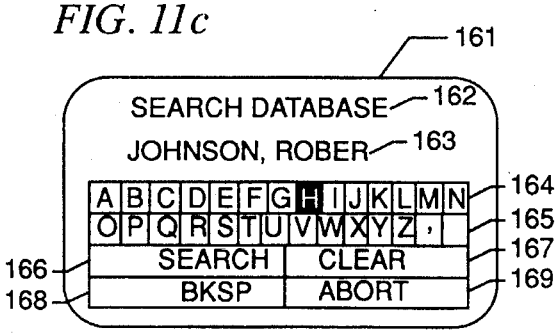

Screen 161 in FIG. 11*e* shows a screen for searching a database of names and telephone numbers, including a screen label 162, field of name to be searched for 163, letters and other characters 164 and 165, and menu items for "Search" 166. "Backspace" 168, "Clear" 167, and "Abort" 169. The selection of a letter appends it to the name field 163, with the search initiated when the "Search" item is selected. "Backspace" erases the last letter added to the name field 163. "Clear" erases the entire name field 163.

Figure 11F:
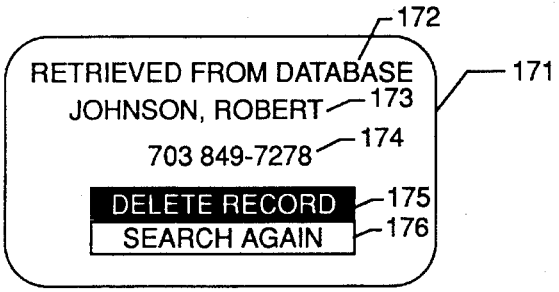

Screen 171 in FIG. 11*f* shows a record retrieved after a search, including screen label 172, name from record 173, telephone number 174, and menu selections 175 and 176. "Delete record" 175 will delete the complete record, while "Search again" 176 results in display of screen 161 so that another search can be done.

Figure 11G:
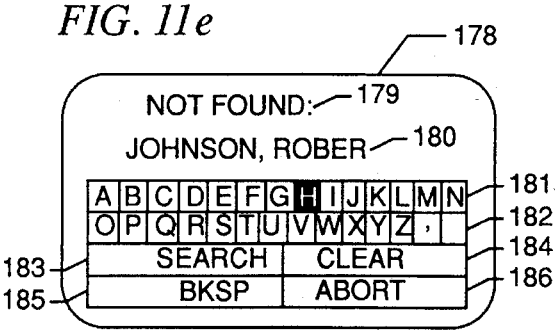

Screen 178 in FIG. 11*g* shows a screen reporting that a record for the name is not found, including screen label 179, name field 180, letters and other characters 181 and 182, and menu items for "Search" 183, "Backspace" 185. "Clean" 184, and "Abort" 186. This screen has the stone functionality as 161 and the user can, for example, correct typographical errors and search again. Other menu items, not shown, allow display of the most similar record and allow retrieval of records before and after that record.

Figure 11H:
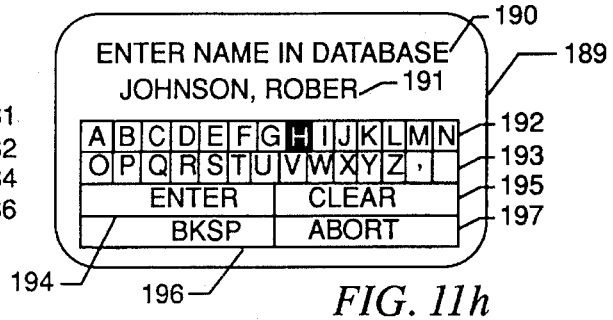

Screen 189 in FIG. 11*h* shows a screen for entering the name for a new record in the database. This screen is called when the "Enter in Database" choice in screen 55 is selected. The screen includes a screen label 190, name field 191, letters and other characters 192 and 193, arid menu items for "Enter" 194, "Backspace" 196, "Clear" 195, and "Abort" 197. "Enter" results in a record being created and a name entered, after which screen 201 is presented.

Figure 11I:
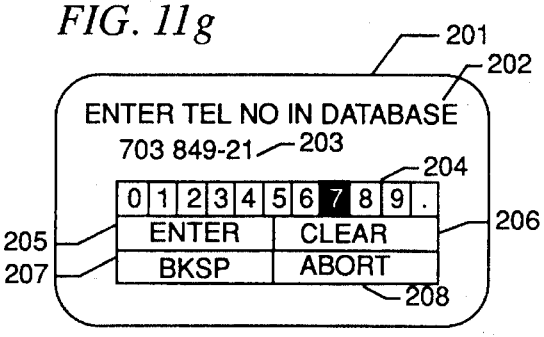

Screen 201 in FIG. 11*i* shows a screen for entering the telephone number for a new record in the database, including screen label 202, field for telephone number 203, digits 0–9 204, and menu items "Enter" 205, "Backspace" 207, "Clear" 206, and "Abort" 208. "Enter" results in completion of the new record, while "Abort" aborts the process.

Figure 11J:
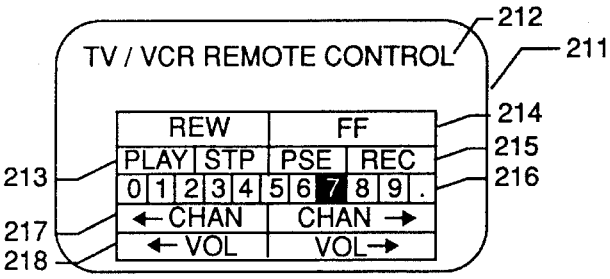

Screen 211 in FIG. 11*j* shows a screen for controlling a television and remote videocassette recorder and/or player, including screen label 212 and VCR control commands rewind 213, fast forward 214, play, stop, pause, and record 215. Remote television controls are also shown, including digits for selecting a channel 216, commands for incrementing and decrementing a channel 217, and turn up and turn down volume 218. Not shown, but available by scrolling down, is a "Return" command, and also other TV and VCR commands. Any command selected results in an appropriate transmission via infrared light, with the screen remaining until "Return" is selected. Note that use of this function requires some additions to the underlying apparatus, including an infrared light emitter and driver, interface to the microprocessor, and a modified counter that provides clock signals to the microprocessor at the appropriate frequency for synchronizing the transmission of the infrared signal.

Figure 12A:
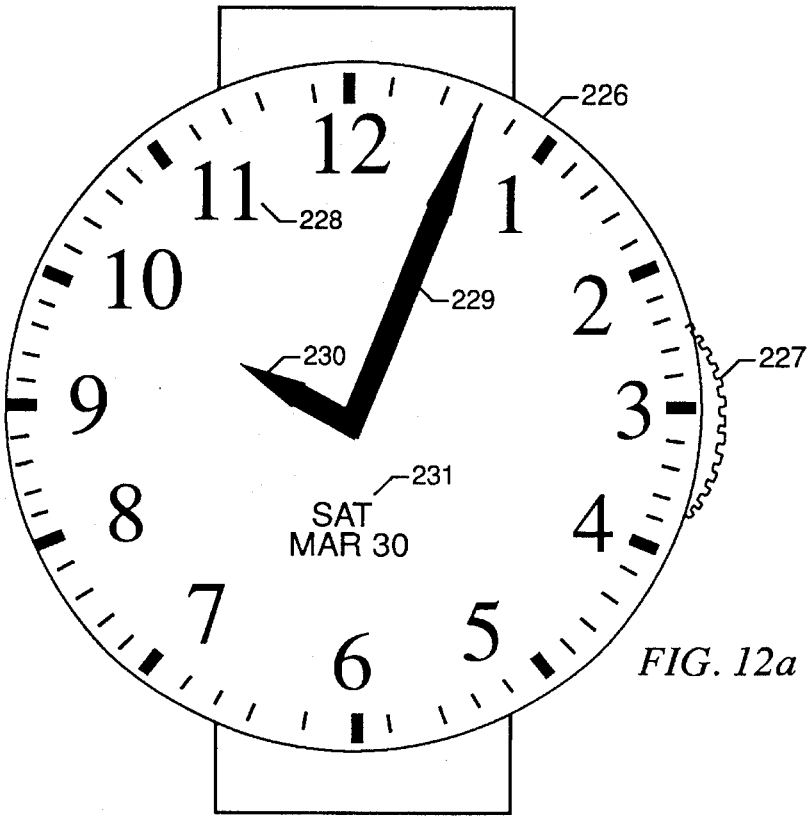
FIGS. 12*a* and 12*b* show alternative display formats designed for a watch using a time display represented in analog (clock) form.
Figure 12B:
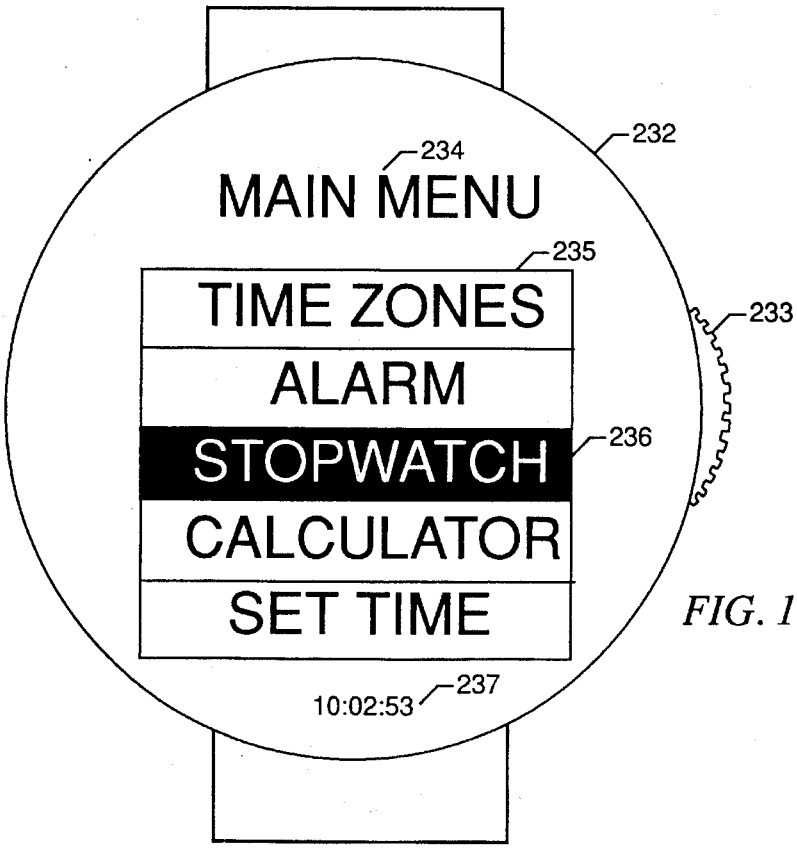

FIGS. 12*a* and 12*b* show alternative display formats designed for a watch using a time display represented in analog (clock) form. The watch uses a high resolution pixel-based display to create a representation with a "big hand" and "little hand" that appears like that of actual movable hands.

The display format above in FIG. 12*a* shows an analog time representation and associated packaging, including watch case 226, thumbwheel 227, number 228, large hand 229, small hand 230, and date 231. This display uses a matrix of pixels, each with a binary intensity value. For a ¾" diameter display and 200 dot per inch resolution, approximately 17,675 pixels are used for the display.

The display format in FIG. 12*b* below shows the main menu display for the analog watch that is analogous to the screen shown in FIG. 1, including watch case 232, thumbwheel 233, screen label 234, and menu 235, including the designated menu item in reverse video 236. Also shown is a digital representation 237 of the current time. The remaining displays are generally the same as that used in the digital form of the watch.

An analog watch display with much lower resolution could be used in an alternative embodiment of the invention that would use LCD display technology of roughly the same resolution and format now used in conventional watches, rather than the higher resolution pixel-oriented displays previously described. In such an alternative, a portion of the screen display, such as the left ⅓, is devoted to an analog display of time using, for example, 12 pairs of segments, each arranged around the center of a clockface, with each pair consisting of a segment the size of a small hand of a clock and a segment that when displayed with the first segment forms a display of a large hand of a clock. Typically, 3 segments are on at a given time, displaying a large and small hand. In the remainder of the display, segments providing for the display of live horizontal lines of characters are arranged, with each character having 9 segments, and each line containing 15 characters. Between each character on a line is a segment consisting of a thin vertical line. In addition, between each horizontal line of characters is a thin vertical line, or set of lines. Finally, a thin vertical line is placed at opposite ends of each horizontal line of characters. By turning on appropriate line segments and vertical and horizontal lines, the appropriate characters and menu arrangements described previously can be constructed. The designated item can be represented by a blinking group of characters, or by providing display segments for lines that allow the display of either dashed or solid lines, with a designated item surrounded by dashed rather than solid lines. The analog display provides an easy-to-read display of the approximate time, while the 9-segment displays can provide accurate (if small) display of the time with resolution to the second.

Figure 13:
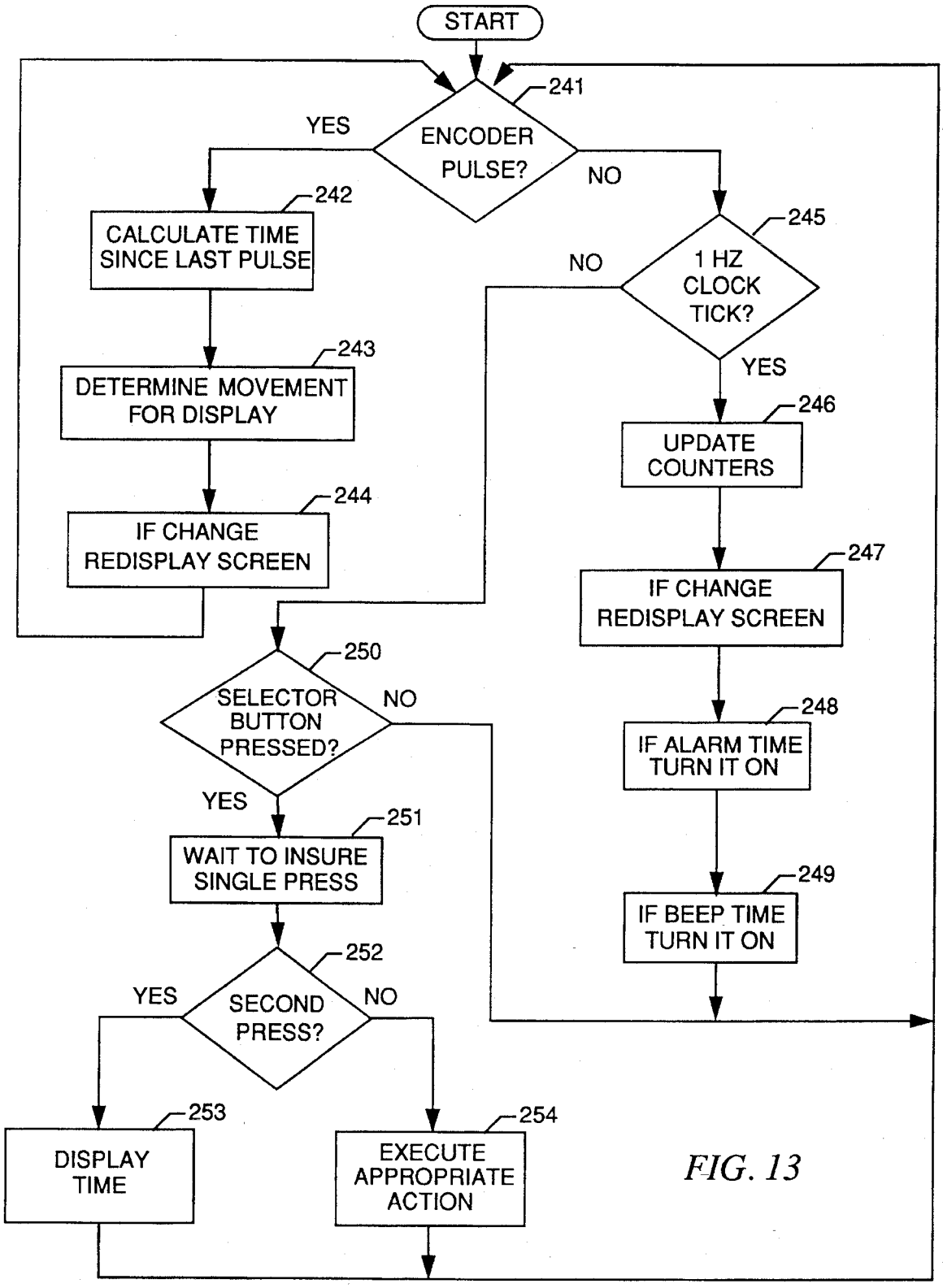
FIG. 13 shows a flowchart of the software architecture for the digital watch.

FIG. 13 shows a flowchart of the software architecture for the digital watch. The software begins by testing 241 to see if a pulse from the thumbwheel encoder has been received. (Note that an additional procedure is included here when the stopwatch is running; see below). If yes, the value of the hundredths of seconds counter is read into the microprocessor and stored in random access memory and the time that the last pulse was received from the encoder is subtracted from this time to calculate 242 the elapsed time since the last pulse. A calculation is then made 243 of the distance that the designation on the display should be moved as a result of the pulse received from the encoder. If the screen has a menu of items, the amount of movement determines which item will be designated by reverse video. If the screen displays a parameter (e.g., minutes) where the potential values and their order are obvious and thus not displayed in menu form, the amount of display "movement" determines the value that will replace that displayed in the field designated by reverse video (see screen 73 in FIG. 14). The display movement results from three factors: (1) the amount of actual physical movement of the thumbwheel: (2) the speed of thumbwheel movement (as discussed in the text associated with FIG. 8); and (3) the form of screen and menu display. In the case of screen displays containing menus with only one item per line, the movement on the display is proportional to the vertical distance of the lines in the menu transversed. In the case of screen displays containing menus with multiple items per line (such as the digits 0–9), the amount of movement on the display is proportional to the cumulative horizontal distance transversed. In some cases it may be desirable to add a correction factor (e.g., 0.75) to be multiplied by the virtual movement to compensate for the tendency for humans to understate such horizontal distances by perceiving them in terms of areas rather than cumulative distances.

If the screen has changed from that previously displayed as a result of the receipt of the pulse, the screen is redisplayed 244. Control then returns to step 241.

If no encoder pulse has been received, a test is made 245 of whether there has been a tick of the 1 hz clock. If yes, the time and date counters are updated 246. First, the seconds counter (which is kept in software in the random access memory) is incremented. If it has reached 60, it is reset to 0 and a carry generated to increment the minutes counter. If the minutes counter has reached 60, it is reset to 0 and a carry generated to increment the hours counter. If the hours counter has reached 13, it is reset to 1 and the AM/PM flag toggled. (If the watch is in a 24-hour mode, the equivalent is performed). If the hours counter and AM/PM flag indicate that a new day has arrived, the day and date counters are incremented. If the date counter indicates a new month has arrived, the month counter is incremented and the date is reset. If the month counter indicates that a new year has arrived, the month counter is reset.

The current screen is then redisplayed 147 to update the time display. A test is then made of whether the new time compares with the alarm time (if daily alarm is set) or with the alarm time and date and, if so, the alarm is turned on 248. Similarly, a test is made of whether the new time is on the hour or half hour if the hourly or half-hourly beep modes are set, and, if so, the appropriate beep sound is turned on 249. Control then returns to step 241.

If there has been no clock tick, a test is made 250 of whether the selection button has been pressed.

If the selector button has been pressed, the software first waits 251 for a period of time (e.g., 350 mS) to see if a second press of the button has occurred. A test is then made 252 of whether a second press has occurred during tilts period. If yes, the basic time display is presented 253, and control passes to step 241. If no, the appropriate action or parameter modification is executed 254. Control then passes to step 241.

If the action involves a time zone, the data structure has two parameters: A tag associated with the (primary) time stored in the counters referred to above that indicates the time zone, and a number indicating the difference in hours between the primary time and a secondary time in a different zone. The software will, when presenting a screen for the time zone, calculate a time zone tag for the secondary time zone based on the time difference.

If the action involves an alarm, the data structure consists of a time in hours and minutes (and is assumed to be in the same time zone as the primary time).

If the function is a stopwatch, the selection of the stopwatch function results in presentation of the screen 112 (shown in FIG. 10), in which the menu items are "Start", "Stop", "Reset", and "Return". "Shirt" initiates the stopwatch and, in so doing, modifies slightly the operation of the software described previously, adding some steps (not shown) before the test of whether a pulse from the thumbwheel encoder has been received. If the stopwatch is running, the microprocessor software checks the state of the 100 hz bit stream: if the input is different from its previous state, the stopwatch "hundredths" counter is incremented. The stopwatch has a timer, kept in software in the random-access memory, that maintains a count of the elapsed time since the "Start" selection in hours, minutes, seconds, and hundredths of seconds. If the stopwatch hundredths counter is incremented, a test is made to see of the result is 100; if so it is set to 0 and a carry made to increment the minutes counter. If the minutes counter is incremented, a test is made to see if the result is 60; if so it is set to 0 and a carry made to increment the hours counter. If the value of the counter has changed, it is redisplayed. "Stop" will stop the counter incrementing. "Reset" will set the value of the counter to 0. If it is desired for the stopwatch to continue running while other functions of the watch are being used, it may be desirable for the 100 hz clock input to not be a single bit but to include the 7-bit binary (or BCD) value, or more, so that the microprocessor can check this value against a software value it keeps and calculate the appropriate changes to the stopwatch counter, should the microprocessor fall behind more than a hundredth of a second. Alternatives include providing a hardware stopwatch timer or providing interrupt hardware for the microprocessor so that clock signal changes and encoder pulses generate a program interrupt.

If the watch is in calculator mode (has the calculator screen presented), a test is made of the item selected. If the item is a digit 0–9 or the decimal point, the character is added to a string of numbers and operators being held for evaluation, and the rightmost N characters (where N is the number of characters that can be displayed) displayed, and control passed to step 241. (For example, the string "3*4" might have a "1" added to result in "3*41".) If the item is an operator (+,–,*, or /, or parentheses to indicate precedence, it is also added to the string and the result displayed. It the item is an "=", the string is evaluated, and the numerical result only placed in a new string, (e.g., "123") and displayed in the accumulator field. Control then passes to step 241.

If the function to be carried out is the search of a database, the name field entered by the user in the search database screen is compared against the name field for each record in the database. Each record in the database consists of a name field with N characters (including a comma, if used) and a telephone number field with M characters (with the number indefinite to allow for local numbers. U.S. area codes, and country and city codes for international calls). The memory consists of an 8-bit byte for each memory location, with a total of P bytes allocated for the database. A special character (e.g., an ASCII STX) defines the beginning of each record (and name field), while an ETX defines the end of the name field and the beginning of the telephone number field, and EOF the end of the database. For most purposes sequential searching, in which an STX is searched for and then the name field following is compared with the name sought, is adequate. If search time is a problem more sophisticated data structures that order records alphabetically, use directories, or techniques such as hash coding, can be used. If a record is found that compares that record is displayed to the user, and control passes to step 241. If an EOF is encountered without any record that compares, a screen indicating that the search was unsuccessful is displayed to the user, and control passes to step 241.

If the function to be carried out is the entry of a new record in the database, the action depends upon the screen the user has been presented, the first of which allows the name to be entered, which is stored at the end of the current memory, and, when the user completes the name entry, an "ETX" is added to memory and the second screen is presented to the user, which allows him or her to enter a telephone number, and then complete the record entry by selecting the "Enter" response. When this occurs an "EOF" is added at the end. If either screen aborts, the "EOF" is returned to the location just after the last complete carry.

If the function to be carried out is the deletion of a record, the record is located and the length of the record in bytes calculated, including the special characters. The remaining data in the memory just after the record to be deleted is then moved up in memory, beginning at the location storing the first data character in the record to be deleted. After each action has been taken program flow returns to step 241.

If the function to be carried out is the setting of the watch, the user chooses the appropriate screen for setting the parameter that must be reset, resetting each parameter one by one until the correct time is displayed. Also included in the list of parameters that can be set is a "Set seconds" screen, which simply presents the tentative time in hours, minutes, and seconds (with the seconds continuously being updated) and provides the user with the choice of resetting the seconds parameter to 0, to 30, or to return without modification.

Once any time parameter is modified, all references to the time will use that new parameter, and the new time will be updated by the ticking of the clock. However, the time will not be finalized until the verification step. After each action involved in setting the watch has been taken program flow returns to step 241.

I claim:

1. A method for the control of a digital watch, comprising the steps of:

displaying an ordered sequence of items in a menu whereby said menu comprises a plurality of horizontal lines, in which each line comprises at least one menu item, and in which at least one line comprises a plurality of menu items arranged side by side, with one of the items from said ordered sequence designated at any given time as tentatively selected by displaying it in a manner distinct from that of other menu items; rotating a cylinder which extends from the face of the watch wherein said cylinder is rotated around an axis that is perpendicular to the plane of the display, and determining the direction and amount of movement of the cylinder;

moving the designation of a menu item in a particular direction within the ordered sequence, depending upon the direction and distance said cylinder was rotated;

repeating the steps of rotating the cylinder, determining the amount of movement, and moving the designation of a menu item until the menu item desired by the user is designated;

actuating a switch, connected to said cylinder, in a direction substantially perpendicular to the axis of rotation of said cylinder to complete the section of said desired menu item.

2. The method of claim 1, calculating the distance that the designation of a menu item moves by multiplying the distance traveled by a point on the circumference of the cylinder by a factor that is an increasing function of the rate of movement of the cylinder.

3. The method of claim 2, wherein the distance that the designation of a menu item moves is proportional to both the distance traveled by a point on the circumference of the cylinder and to a constant, with said constant having one value when the rate of movement of the cylinder is below a given threshold value, and a different value when said rate of movement is above said threshold value.

4. The method of claim 1, wherein the display comprises a set of horizontal lines, with more than one menu item presented in at least one horizontal line, and with the designation moving from left to right within a line and from the last item on one line to the first item on the line below as the cylinder moves in a clockwise direction.

5. The method of claim 2, wherein the distance the designation of a menu item moves is proportional to the cumulative horizontal distance of the entire display occupied by the menu items, for a given amount of movement of the cylinder and correction for the rate of movement.

6. The method of claim 1, wherein an attempt to move the designated menu item beyond either end of the sequence of menu items will result in the display of one or more additional menu items, the simultaneous removal of the display of that menu item at the opposite end of the sequence, and the shifting of all intervening horizontal lines up or down, as appropriate, should there be more items in the menu that can be displayed at a given time.

7. The method of claim 1, wherein the designated menu item has its lettering displayed at the intensity level used for display of the background in undesignated menu items and the background of said designated menu item is displayed at the intensity level used for display of the lettering in undesignated menu items.

8. The method of claim 1, wherein the menu items comprise a set of numerical digits and mathematical operators that can be entered to control a calculator contained in the watch.

9. The method of claim 1, wherein the menu items comprise a set of alphanumeric characters that can be entered into a memory contained in the watch.

10. The method of claim 1, wherein the switch must first be actuated before movement of the designated item in the menu can occur.

11. An apparatus for control of a digital watch, comprising:

a microprocessor;

a memory for storage of a computer program for the control of said microprocessor and for other information;

a display for presenting information from the microprocessor to a user as an ordered sequence of items in a menu whereby said menu comprises a plurality of horizontal lines, in which each line comprises at least one menu item, and in which at least one line comprises a plurality of menu items ordered side by side with one of the items from said ordered sequence designated at any given time as tentatively selected by displaying it in a manner distinct from that of other menu items;

a cylinder capable or rotation in either direction, with a portion of cylinder extending from the case of said watch;

means for determining the direction and amount of movement of said cylinder and calculating the distance the designation of a menu item is to be moved; and a switch connected to the cylinder that closes, given sufficient pressure in a direction toward the axis of rotation of the cylinder, with the closing of said switch causing selection of the desired menu item, and the state of the switch provided to the microprocessor.

12. The apparatus of claim 11, wherein the rotating cylinder is mounted within the packaging of the watch such that the axis the cylinder rotates around is perpendicular to the plane of the watch display face.

* * * * *